US009987517B1

(12) United States Patent
Kuo

(10) Patent No.: US 9,987,517 B1
(45) Date of Patent: Jun. 5, 2018

(54) JOINT STRUCTURE OF ENDLESS TREADMILL BELT OF TREADMILL

(71) Applicant: SportsArt Industrial Co., Ltd., Tainan (TW)

(72) Inventor: Hai-Pin Kuo, Tainan (TW)

( * ) Notice: Subject to any disclaimer, the term of this patent is extended or adjusted under 35 U.S.C. 154(b) by 0 days. days.

(21) Appl. No.: 15/372,278

(22) Filed: Dec. 7, 2016

(51) Int. Cl.
*A63B 22/00* (2006.01)
*A63B 22/02* (2006.01)

(52) U.S. Cl.
CPC ..... *A63B 22/0285* (2013.01); *A63B 22/0235* (2013.01)

(58) Field of Classification Search
None
See application file for complete search history.

(56) References Cited

U.S. PATENT DOCUMENTS 3,842,551 A * 10/1974 Shull, Jr. ..... E04F 13/04 428/161
5,562,796 A * 10/1996 Ertel ..... B29C 65/18 100/258 A
5,906,270 A * 5/1999 Faulkner ..... B65G 17/086 198/853
5,951,441 A * 9/1999 Dalebout ..... A63B 22/02 198/844.2
9,012,341 B2 * 4/2015 Rohr ..... A63B 22/02 442/221
9,188,192 B2 * 11/2015 Cancienne, Jr. ..... F16G 3/006
9,505,241 B2 * 11/2016 Cuzin ..... F16G 3/02
9,540,174 B2 * 1/2017 Josserond ..... B65G 15/34
2012/0053020 A1 * 3/2012 Wright ..... B65G 15/34 482/54
2017/0043524 A1 * 2/2017 Guttenberg ..... B29C 66/855

* cited by examiner

*Primary Examiner* — Stephen R Crow

(57) ABSTRACT

A joint structure of an endless treadmill belt of a treadmill is provided. The treadmill belt is a sandwich-type laminated rectangular treadmill belt. Two ends of the treadmill belt are cut to form serrations. Two ends of a bottom layer of the treadmill belt are meshed with each other. At least one plastic piece is placed on the joint of the two ends of the bottom layer. The serrations of two ends of a top layer of the treadmill belt are connected with each other in a cross-knitted manner, and the pointed portions of the serrations of the two ends of the top layer are inserted into and covered by the plastic piece and then the two ends of the treadmill belt are joined together by hot melting to form an integral flat joint of the treadmill belt.

3 Claims, 6 Drawing Sheets

JOINT STRUCTURE OF ENDLESS TREADMILL BELT OF TREADMILL

FIELD OF THE INVENTION

The present invention relates to a joint structure of an endless treadmill belt of a treadmill. The treadmill belt is a sandwich-type laminated rectangular treadmill belt. Two ends of the treadmill belt are cut to form serrations. Two ends of a bottom layer of the treadmill belt are meshed with each other. At least one plastic piece is placed on the joint of the two ends of the bottom layer. The serrations of two ends of a top layer of the treadmill belt are connected with each other in a cross-knitted manner, and the pointed portions of the serrations of the two ends of the top layer are inserted into and covered by the plastic piece and then the two ends of the treadmill belt are joined together by hot melting to form an integral flat joint of the treadmill belt.

BACKGROUND OF THE INVENTION

A treadmill comprises a bottom frame and a deck for a user to stand thereon. The deck is provided with an endless treadmill belt to circle round the deck. Because the treadmill belt of the treadmill is tightly matched with two transmission rollers, under the long-term friction between the deck and the treadmill belt, the treadmill belt is likely to cause a crack to affect its service life. The joint way of the treadmill belt of a conventional treadmill is that both ends of the treadmill belt have a certain length to be overlapped and connected by hot pressing to form an endless treadmill belt. The contact area of the joint of both ends of the treadmill belt is small. Under the long-term friction between the deck and the treadmill belt, the joint of both ends of the treadmill belt is easy to break to affect its service life. In view of this, the inventor of the present invention have carefully studied and developed a more practical joint structure, allowing the endless treadmill belt to be more stable. The present invention has been developed after many attempts of conceiving and testing.

SUMMARY OF THE INVENTION

In view of the shortcomings of the prior art, the primary objective of the present invention is to provide a joint structure of an endless treadmill belt of a treadmill. The treadmill belt is a sandwich-type laminated rectangular treadmill belt. Two ends of the treadmill belt are cut to form serrations. Two ends of a bottom layer of the treadmill belt are meshed with each other. At least one plastic piece is placed on the joint of the two ends of the bottom layer. The serrations of two ends of a top layer of the treadmill belt are connected with each other in a cross-knitted manner, and the pointed portions of the serrations of the two ends of the top layer are inserted into and covered by the plastic piece and then the two ends of the treadmill belt are joined together by hot melting to form an integral flat joint of the treadmill belt.

DESCRIPTION OF THE PREFERRED EMBODIMENTS

Embodiments of the present invention will now be described, by way of example only, with reference to the accompanying drawings.

Figure 1:
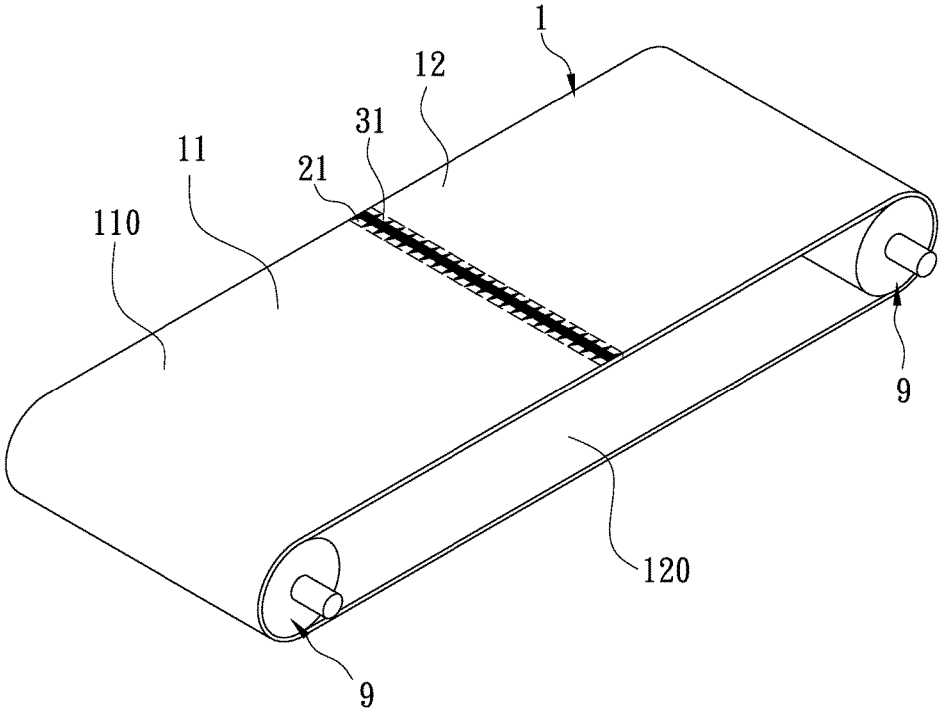
FIG. 1 is a perspective view of the treadmill belt fitted on the rollers of the treadmill of the present invention when in use.
Figure 2:
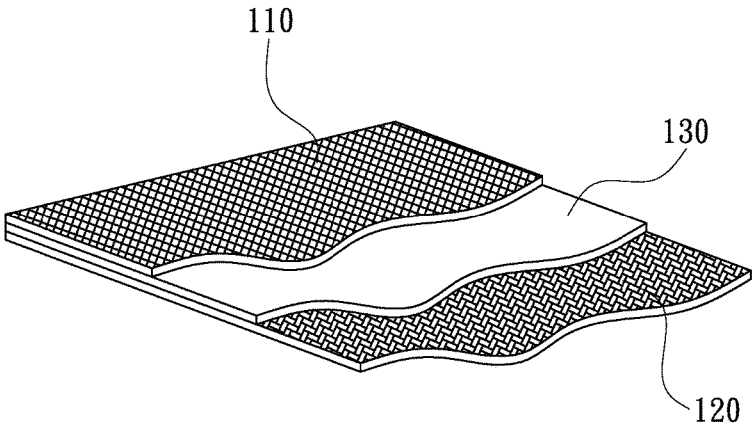
FIG. 2 is a schematic view of the treadmill belt of the present invention.
Figure 3:
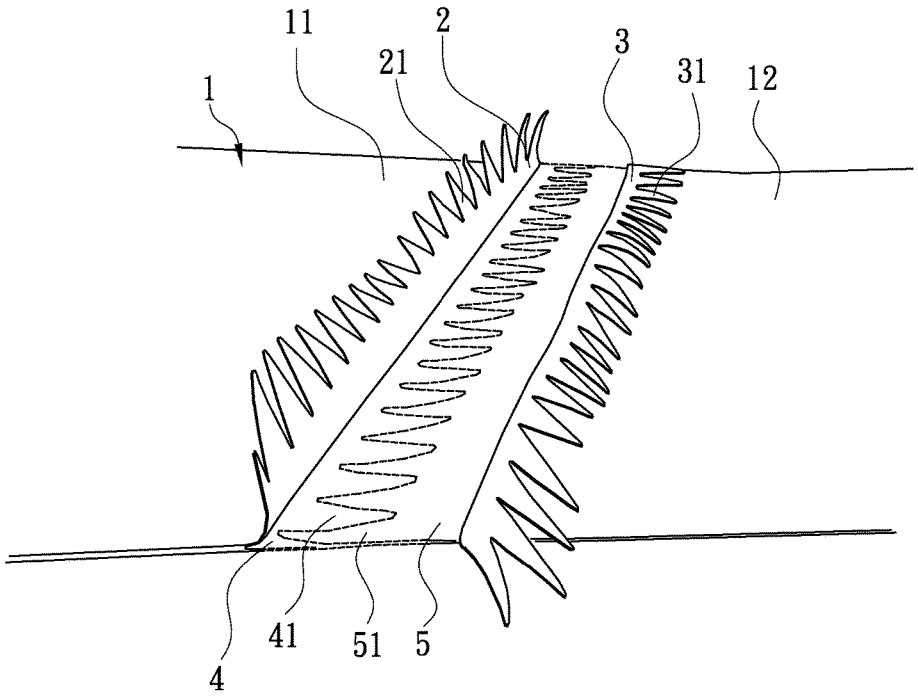
FIG. 3 is a schematic view showing the joint of two ends of the bottom layer of the treadmill belt of the present invention.
Figure 4:
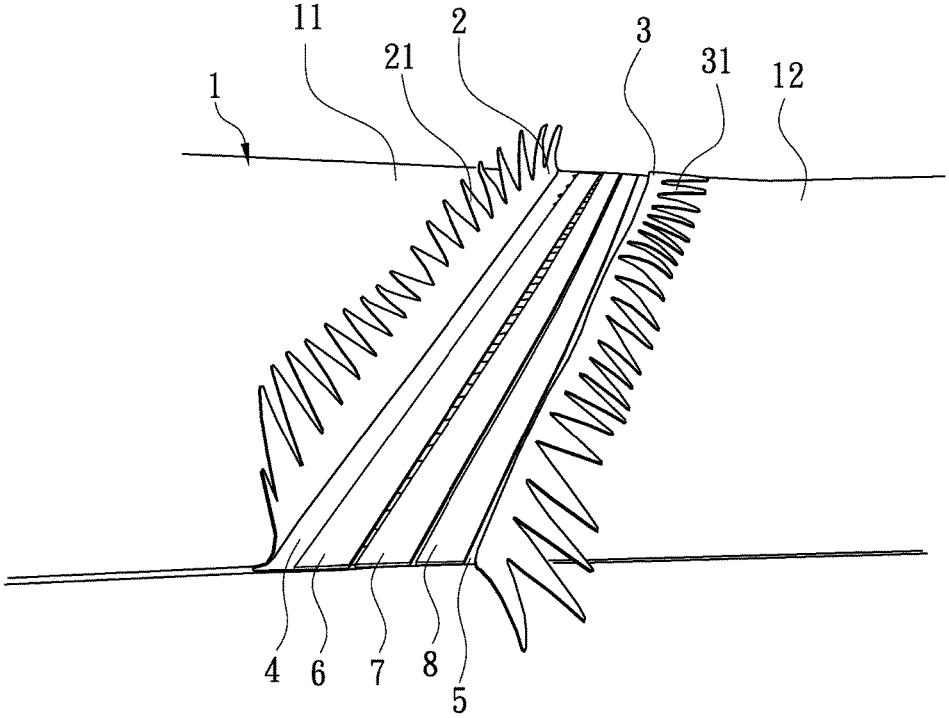
FIG. 4 is a schematic view showing the plastic pieces placed on the joint of the bottom layer of the treadmill belt of the present invention.
Figure 5:
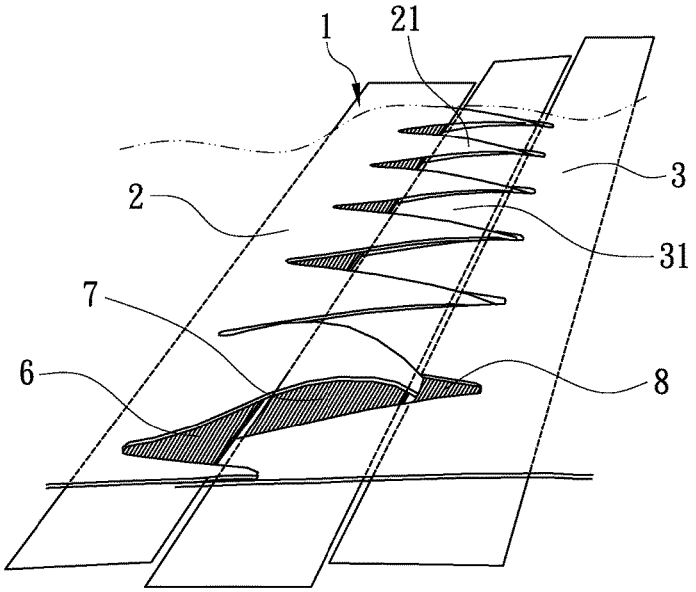
FIG. 5 is a schematic view showing that the pointed portions of the serrations of the top layer are inserted into and covered by the endmost plastic piece on the bottom layer of another end of the treadmill belt of the present invention.
Figure 6:
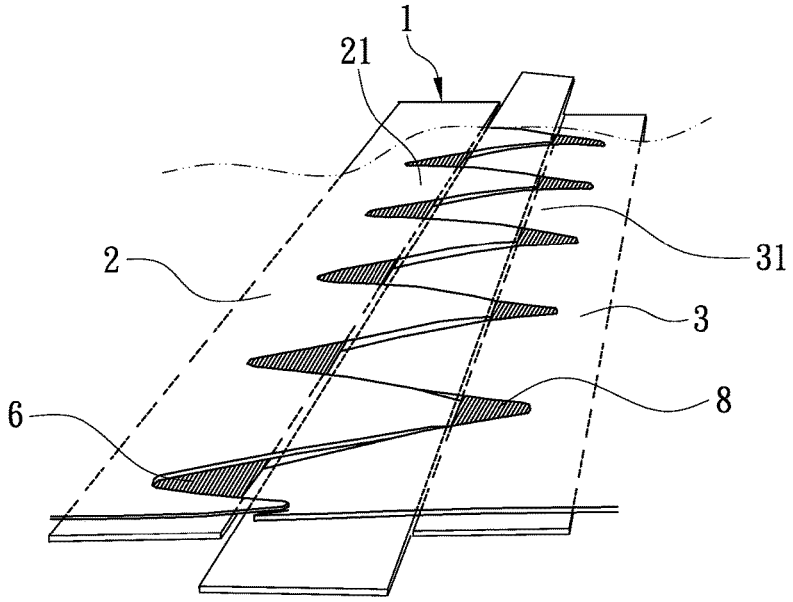
FIG. 6 is a schematic view showing that the two ends of the treadmill belt are joined together by hot melting to form an integral flat joint of the treadmill belt of the present invention.

Referring to FIG. 1, the present invention is to provide a joint structure of an endless treadmill belt of a treadmill. The treadmill belt 1 is fitted on rollers 9 of the treadmill to be driven in a circular manner, as shown in FIG. 1. The rollers 9 are driven by a motor by means of a mechanical transmission, which is well known and not shown in the drawings. When the motor is running, the treadmill belt 1 is driven to circle, so that the user can stand on the treadmill belt 1 for exercise.

Referring to FIG. 2 through FIG. 6, the treadmill belt 1 of the present invention is a sandwich-type laminated rectangular treadmill belt 1. The rectangular treadmill belt 1 is composed of two PET (polyethylene terephthalate) woven fabrics and a PVC (polyvinyl chloride) contact layer 130 located between the two PET woven fabrics. Two ends of the treadmill belt 1 are transversely cut in a zigzag shape for a predetermined length, so that a left end 11 and a right end 12 of a top layer 110 and a bottom layer 120 of the treadmill belt 1 are formed with an upper left layer 2, an upper right layer 3, a lower left layer 4, and a lower right layer 5, respectively. Serrations 41, 51 of the ends of the lower left layer 4 and the lower right layer 5 are meshed with each other and bonded to each other. In an embodiment, three plastic pieces 6, 7, 8 are placed on the joint of the lower left layer 4 and lower right layer 5. Each of the plastic pieces 6, 7, 8 is composed of two PVC sheets and a PET woven fabric located between the two PVC sheets. Serrations 21 of the upper left layer 2 of the left end 11 of the treadmill belt 1 cover the plastic pieces 6, 7, and the pointed portions of the serrations 21 of the upper left layer 2 are inserted into and covered by the plastic piece 8 on the lower right layer 5 of the right end 12. Serrations 31 of the upper right layer 3 of the right end 12 of the treadmill belt 1 cover the plastic pieces 7, 8, and the pointed portions of the serrations 31 of the upper right layer 3 are inserted into and covered by the plastic piece 6 on the lower left layer 4 of the left end 11. That is to say, the serrations 21, 31 of the two ends of the top layer 110 of the treadmill belt 1 are connected with each other in a cross-knitted manner, and then the two ends of the treadmill belt 1 are joined together by hot melting to form an integral flat joint of the treadmill belt 1. The treadmill belt 1 is quite firm and durable.

In summary, the treadmill belt 1 of the present invention employs a new technique to divide the top layer 110 and the bottom layer 120 into the upper left layer 2, the lower left layer 4, the upper right layer 3, and the lower right layer 5. The two ends of the treadmill belt 1 are cut in a zigzag shape. The serrations 21, 31 of both ends of the top layer 110 of the treadmill belt 1 are connected with each other in a cross-knitted manner, and then the two ends of the treadmill belt 1 are joined together by hot melting to form an integral flat joint of the treadmill belt 1. This joint is a sandwich-type configuration to from a stable and durable treadmill belt 1.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A joint structure of an endless treadmill belt of a treadmill, the treadmill belt being fitted on rollers of the treadmill, the rollers being driven by a motor, when the motor is running, the treadmill belt being driven to circle, two ends of the treadmill belt being transversely cut in a zigzag shape for a predetermined length, a left end and a right end of a top layer and a bottom layer of the treadmill belt being formed with an upper left layer, an upper right layer, a lower left layer and a lower right layer each having serrations at respective ends thereof, the serrations of the two ends of the top layer of the treadmill belt being connected with each in a cross-knitted manner, the two ends of the treadmill belt being joined together by hot melting to form an integral flat joint of the treadmill belt, wherein the serrations of the respective ends of the lower left layer and the lower right layer are meshed with each other and bonded to each other, and at least one plastic piece is placed on a joint of the lower left layer and the lower right layer.

2. The joint structure of an endless treadmill belt of a treadmill as claimed in claim 1, wherein the serrations of the top layer at one end of the treadmill belt are inserted into and covered by the plastic piece on the bottom layer at another end of the treadmill belt, namely, the serrations of the upper left layer of the left end of the treadmill belt cover two plastic pieces close to the left end and pointed portions of the serrations of the upper left layer are inserted into and covered by one plastic piece next to the right end on the lower right layer of the right end, the serrations of the upper right layer of the right end of the treadmill belt cover two plastic pieces close to the right end and pointed portions of the serrations of the upper right layer are inserted into and covered by one plastic piece next to the left end on the lower left layer of the left end, and the two ends of treadmill belt are joined together by means of hot melting to form the integral flat joint of the treadmill belt.

3. The joint structure of an endless treadmill belt of a treadmill as claimed in claim 1, wherein the plastic piece is composed of two PVC (polyvinyl chloride) sheets and a PET (polyethylene terephthalate) woven fabric located between the two PVC sheets.

* * * * *